United States Patent [19]

Rudd

[11] Patent Number: 4,679,380

[45] Date of Patent: Jul. 14, 1987

[54] TREATMENT OF POROUS STRUCTURES

[76] Inventor: Norman Rudd, 110 London Rd., Aston, Clinton, Aylesbury, Buckinghamshire, United Kingdom

[21] Appl. No.: 767,294

[22] PCT Filed: Nov. 30, 1984

[86] PCT No.: PCT/GB84/00412

§ 371 Date: Aug. 1, 1985

§ 102(e) Date: Aug. 1, 1985

[87] PCT Pub. No.: WO85/02429

PCT Pub. Date: Jun. 6, 1985

[30] Foreign Application Priority Data

Dec. 2, 1983 [GB] United Kingdom ..... 8332209

[51] Int. Cl.[4] ..... B65B 3/00; B65B 63/00

[52] U.S. Cl. ..... 53/440; 53/551; 52/169.14; 52/515; 52/743

[58] Field of Search ..... 53/440, 451; 52/169.14, 52/515, 743, 744

[56] References Cited

U.S. PATENT DOCUMENTS 2,613,488 10/1952 Attride .
3,324,621 6/1967 Runge .
3861522 1/1975 Llewellyn ..... 53/451 X
3,987,602 10/1976 Stahl ..... 53/440

FOREIGN PATENT DOCUMENTS 1365867 9/1974 United Kingdom ..... 52/169.14

*Primary Examiner*—John Sipos
*Attorney, Agent, or Firm*—Townsend and Townsend

[57] ABSTRACT

A treating solution e.g. for forming a damp course in porous walls, is encapsulated in a plastics tube. The filled tube is frozen to produce solid rods of treating solution which, after stripping the jacket, can be inserted in bore holes in a building wall to thaw and be absorbed into the wall. To obtain a frozen rod that is substantially cylindrical over its whole length, the plastics material at each end of the liquid-containing tube is bundled together and clamped to maintain the tube in a substantially cylindrical shape.

9 Claims, 8 Drawing Figures

TREATMENT OF POROUS STRUCTURES

Figure 1:
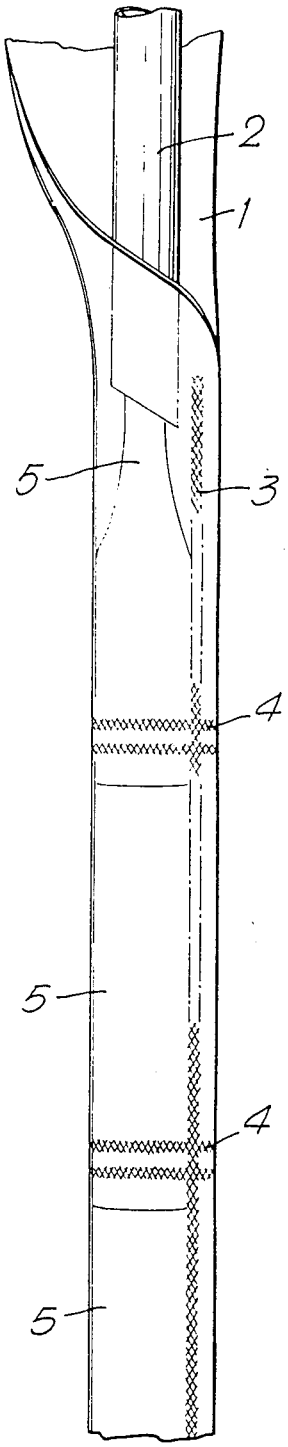

This invention is concerned with the treatment of porous structures, and particularly with damp-proofing the wall of buildings or treating timber with fungicide or insecticide.

In my British Pat. Nos. 1,365,867 and 1,531,276 I describe a method of treating a porous structure in which a frozen rod or pellet of a treating solution which is liquid at ambient temperature is placed in a bore in the structure and allowed to thaw, thus allowing the treating solution to seep gently into the porous structure. This method has been used with great success to introduce aqueous solutions of sodium or potassium methyl siliconate into masonry walls to form a damp course. The use of such frozen rods, which are sold under the Registered Trade Mark FREEZTEQ, is covered by Agreement Certificate No. 81/827 and is the subject of British Pat. No. 1365867. British Pat. No. 1531276 discloses how the same technique can be used to dose timber (or masonry) with a fungicide or insecticide.

A problem in the use of this technique has been that the moulding operation for forming the frozen rods can be slow and cumbersome using copper or plastics tube which must be filled by the contractor and frozen immediately thereafter. The frozen rods can only be prepared in relatively small quantities depending on the freezing capacity of the contractor.

I have now developed a technique in which the treating solution is sealed into cylindrical plastics jackets to form a pre-pack treating composition which can be mass-produced, then readily transported and stored by the contractor for freezing as required. The pre-packs occupy less space in a freezer that the previous moulds, and so allow an increase in the production capacity of the contractor. Additionally, the plastics jackets make it easy to store and handle the treating solution before freezing, and make the handling of the frozen rods easier after freezing. The frozen rods can be taken to the work site in their jackets which can be stripped from the rods using a knife before insertion in the structure to be treated. As a modification the plastics jacket can be provided with a tear strip by which the jacket may be opened circumferentially or longitudinally to allow the rod to be removed.

In its simplest form the present invention provides a tube of solution-inpermeable plastics material containing the treating solution and sealed at each end. In its preferred form, the sealed ends of the tube are bundled and clamped to maintain the filled tube in a substantially cylindrical form.

A jacketed frozen composition produced by freezing a tube with a simple straight heat seal at each end is still usable in the technique of my previous patents, but the frozen rod will have fish tail shaped ends which will need to be trimmed to enable them to be inserted snugly in a bore hole, with consequent wastage of the material.

Figure 3A:
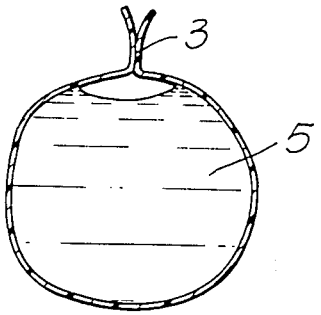
Figure 3B:
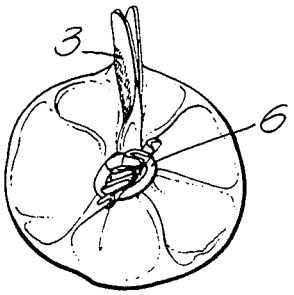
Figure 2A:
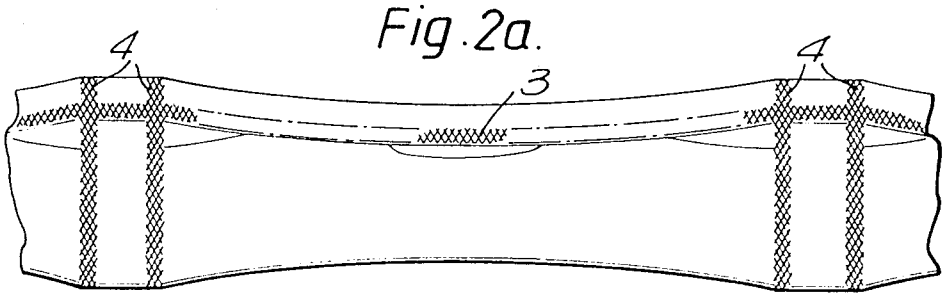
Figure 2B:
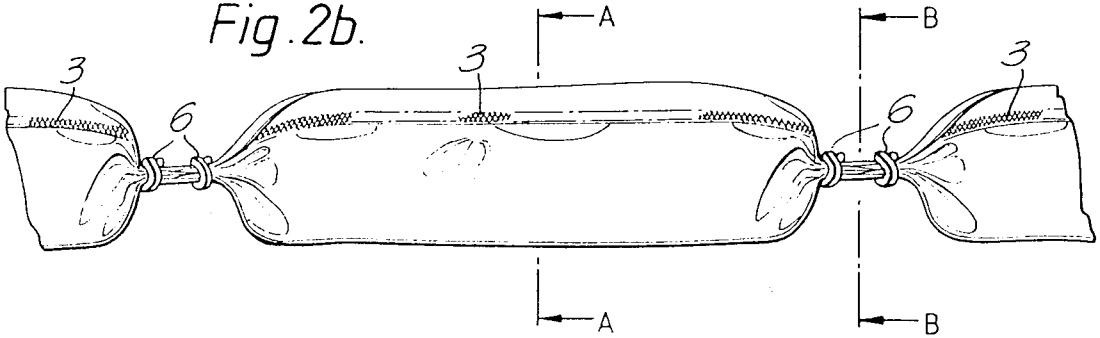
Figure 2C:
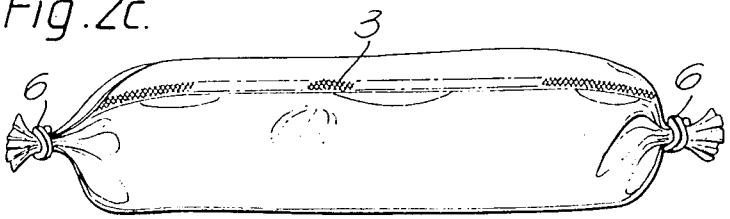
Figure 4A:
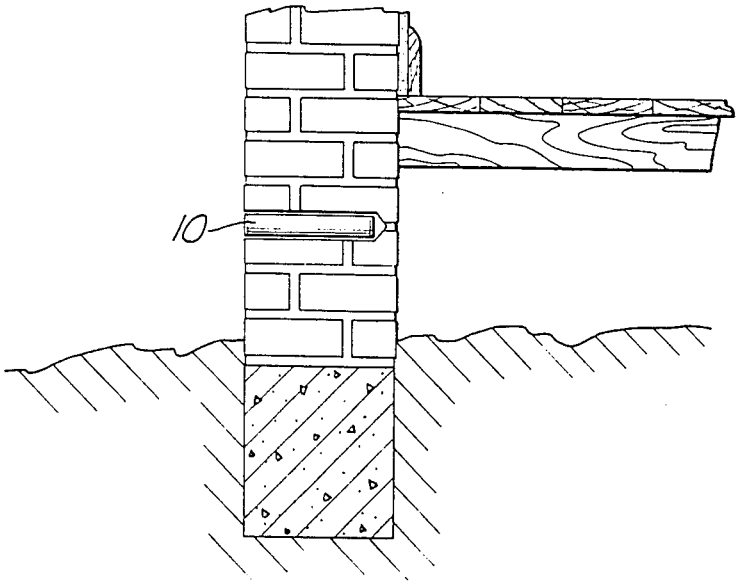
Figure 4B:
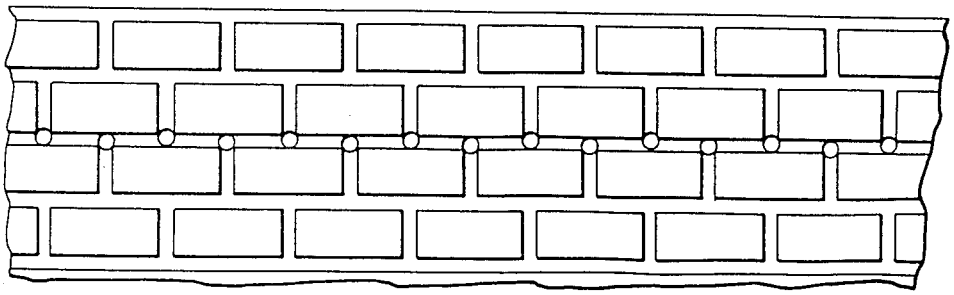

An embodiment of the invention will now be described in more detail, by way of example only, making reference to the accompanying drawings, in which:

FIG. 1 illustrates the formation and filling of plastics jackets,

FIG. 2 shows (*a*) a strip of sealed jacket after filling, (*b*) the bunching of the ends of the jackets, and (*c*) the final separated cylindrical jacketed pre-pack, FIG. 3 shows (*a*) a section along line A—A of FIG. 2(*b*) and (*b*) a section along line B—B of FIG. 2(*b*), and FIG. 4 shows (*a*) a schematic section through a wall being treated with a Freezteq frozen rod, and (*b*) a front view of the wall showing the positioning of bore holes.

Referring to FIG. 1 of the drawings, the plastics tubes for jacketing the liquid treating composition are advantageously formed from plastics strip 1. The strip 1 which is fed from a reel and shaped around a hollow mandrel 2 so that overlapping edges of the strip 1 can be heat sealed longitudinally along a seam 3 to form a tube. The lower end is sealed with a transverse heat seal to form seams 4 and as the seam 3 is formed the newly formed tube is moved downwardly. The tube is then charged with a predetermined amount of treating solution 5 through the hollow mandrel 2. The tube is then moved downwardly again and heat sealed at its other end with a further transverse seal. The sealing of the upper end of the filled tube simultaneously forms the lower end seal for the next tube. Another longitudinal seal is made to form the next empty tube for further filling.

The result of this operation is the formation of a strip of linked, sealed and filled tubes as shown in FIG. 2(*a*). The plastics material is then bundled in the region of the transverse heat seals separating the filled sections. A clamp 6 is attached to each end of the filled sections to grip the bundle and bring the tube into a substantially cylindrical shape. One efficient form of clamping is the use of metal wire clips known as "Polyclips". Adhesive tape may also be used. After clamping the bundled heat seal section, the filled sections are severed from each other by cutting through the plastics material between the transverse heat seals to produce individual cylindrically jacketed tubes of treating solution.

The finished tubes as shown in FIG. 2(*c*) can be readily packed into large boxes and transported to the contractors using the system. The boxed tubes can then be stored by the contractor until needed for freezing, and the contractor is removed from the need to store treating solution and fill moulds for freezing. The pre-packed treating solution can be frozen as required by the contractor.

Clearly the plastics tube must be impermeable to the solvent of the treating solution, which for ease of use will generally be water, and the impermeability must be sufficient to withstand prolonged storage. We have found that suitable materials are a polyester/polyethylene laminate, or high density polyethylene. The important characteristics required for a strip to be used in the process as described are that it is impermeable to the solution and capable of taking a heat seal which will withstand the bundling and clamping described.

After freezing, jacketed frozen rods are taken to the work site in insulated containers. The plastics jacket may be stripped from the frozen rod on site by slitting the jacket with a knife. Alternatively, the jacket may be formed so that there are lines of weakness in the plastics material and a tag so that a tear strip is formed which can be gripped by the operator to open the jacket.

As shown in FIG. 4, a frozen rod 10 of a damp-proofing solution can be inserted in a bore hole in a brick wall where it is allowed to thaw so that the solution seeps by capillary action into the surrounding masonry. As shown in FIG. 4(*b*) the bore holes are preferably formed in the mortar bedding of the bricks at 4½ inch intervals so that with standard 9 inch bricks treating solution contacts the middle and ends of each brick along the chosen line of treatment. At this spacing we recommend that a bore hole of 22 mm diameter is provided and for such a bore hole we aim to produce a frozen rod of substantially 20 mm diameter. After the frozen rod has thawed and the solution has been absorbed in the wall, further rods can be inserted until the desired dosage is reached.

Further details of the treatment of building structures with damp-proofing solutions and with fungicidal and insecticidal solutions can be found in the published specifications of my British Pat. Nos. 1,365,867 and 1,531,276.

I claim:

1. A method for the treatment of a porous structure with a treating solution, comprising the steps of:

forming a tube from plastics material, the tube having a diameter;

seaming the tube with a first transverse seam to form a first end of a jacket;

filling the jacket with the treating solution through a second end of the jacket which is open;

sealing the jacket with a second transverse seam to close the second end;

bundling the jacket in the region of the first and second ends of the jacket to form a substantially cylindrical rod;

freezing the jacket and the enclosed treating solution to form a rod;

removing the jacket from the rod of treating solution; and inserting the rod of the treating solution into a cylindrical opening in the porous structure wherein the diameter of the cylindrical opening is greater than the diameter of the tube.

2. The method of claim 1, wherein the tube includes a tear strip and wherein the step of removing the jacket from the rod of treating solution further comprises pulling the tear strip to tear the plastics material.

3. The method of claim 1, wherein the seaming, filling, sealing and bundling steps are repeated to produce continuous jackets, and further comprising the step of severing the individual jackets from one another in the region of the bundled ends.

4. The method of claim 3 further comprising the step of advancing the plastics material between the steps of sealing the second end of one jacket and the seaming of the first end of a subsequent jacket such that the second end of one jacket is spaced apart from the first end of a subsequent jacket.

5. A method for the treatment of a porous structure with a treating solution, comprising the steps of:

providing cylindrical openings in the porous structure;

forming a longitudinally sealed tube from a strip of plastics material;

seaming the tube at a first end with a first transverse seam to form a jacket;

filling the jacket with the treating solution through a second end of the tube;

sealing the jacket at the second end with a second transverse seam;

bundling the jacket in the region of the first and second ends to form a substantially cylindrical rod having a diameter less than the diameter of the cylindrical openings provided in he porous structure;

repeating the seaming, filling, sealing and bundling steps;

severing the individual jackets from one another;

freezing the jackets and the enclosed treating solution to form a rod;

removing the jacket from the rod of treating solution; and inserting the rod into the cylindrical openings of the porous structure.

6. The method of claim 5 wherein the tube includes a tear strip and wherein the step of removing the jacket from the rod further comprises pulling the tear strip to tear the plastics material.

7. The method of claim 5, further comprising the step of advancing the plastics material between the steps of sealing the second end of one jacket and seaming the first end of a subsequent jacket such that the second end of one jacket is spaced apart from the first end of a subsequent jacket.

8. A method of treatment of a porous structure with a treatment liquid comprising forming a strip of plastics material into a tubular shape around a hollow mandrel, forming longitudinal and transverse seams to define an open tube around the mandrel, injecting a treatment liquid into the tube through the mandrel, forming a transverse seal to seal the treatment liquid within the formed tube, advancing the strip to repeat the seaming and filling operations, severing individual tubes from the linked strip of sealed tubes thus formed, freezing the liquid in at least one of the sealed tubes to form a frozen rod, drilling a suitable hole into the porous structure to be treated, removing a frozen rod of the treatment liquid from within a sealed tube, and inserting said frozen rod into said drilled hole whereby the frozen rod may melt and the treatment liquid may permeate into the porous structure to treat said porous structure.

9. Method as claimed in claim 8 in which the plastics material of the sealed tube is bundled together and clamped at each end to maintain the tube in a substantially cylindrical shape.

* * * * *